US006942781B2

(12) United States Patent
Kuhn et al.

(10) Patent No.: US 6,942,781 B2
(45) Date of Patent: Sep. 13, 2005

(54) METHOD FOR ELECTROPLATING A STRIP OF FOAM

(75) Inventors: Marc Kuhn, Pontpierre (LU); Louis Masotti, Sonlez (LU); Damien Michel, Bromont (CA); Liyan Yang, Blegny (BE)

(73) Assignee: Efoam S.A., Luxembourg (LU)

( * ) Notice: Subject to any disclaimer, the term of this patent is extended or adjusted under 35 U.S.C. 154(b) by 215 days.

(21) Appl. No.: 10/380,816

(22) PCT Filed: Sep. 12, 2001

(86) PCT No.: PCT/EP01/10517

§ 371 (c)(1),
(2), (4) Date: Mar. 18, 2003

(87) PCT Pub. No.: WO02/22914

PCT Pub. Date: Mar. 21, 2002

(65) Prior Publication Data

US 2003/0188973 A1 Oct. 9, 2003

(30) Foreign Application Priority Data

Sep. 18, 2000 (LU) ..... 90640

(51) Int. Cl.[7] ..... C25D 7/06; C25D 5/00; C25D 7/00; C25D 5/54; C25D 5/10

(52) U.S. Cl. ..... 205/138; 205/143; 205/150; 205/161; 205/170; 205/176; 205/182; 205/191; 205/210; 205/224; 205/317

(58) Field of Search ..... 205/138, 143, 205/150, 161, 210, 317, 170, 176, 182, 191, 224; 204/199, 202, 206

(56) References Cited

U.S. PATENT DOCUMENTS

| | | | | |
|---|---|---|---|---|
| 1,750,831 A | | 3/1930 | Carns | |
| 3,362,893 A | | 1/1968 | Amaro et al. | |
| 4,326,931 A | * | 4/1982 | Kamijo et al. | 205/138 |
| 4,892,626 A | * | 1/1990 | Covey | 205/130 |
| 6,290,832 B1 | * | 9/2001 | Bugnet et al. | 205/161 |
| 6,471,846 B1 | * | 10/2002 | Ohba | 205/137 |

FOREIGN PATENT DOCUMENTS

| | | |
|---|---|---|
| DE | 19842974 A1 | 3/2000 |
| EP | 0761710 A1 | 3/1997 |
| JP | XP-002189329 | 4/1988 |
| JP | 07034299 | 2/1995 |

* cited by examiner

*Primary Examiner*—Edna Wong
(74) *Attorney, Agent, or Firm*—McCormick, Paulding & Huber LLP

(57) ABSTRACT

A method for electroplating a strip of foam having two opposite sides and an electrically conductive surface, including:

(a) continuously applying the strip of foam onto a moving cathode immersed in an electroplating bath so that the strip travels through the bath in contact with the moving cathode to electroplate metal on the strip of foam, a first side of the strip of foam facing a working surface of the moving cathode, and (b) continuously removing the electroplated strip of foam from the moving cathode when metal has been plated to a desired thickness;

A metal foil is continuously formed by electrodeposition on the working surface of the moving cathode in such a way that the strip of foam is applied at step (a) onto the moving cathode over the metal foil; and, after step (b), the metal foil is continuously removed from the moving cathode.

13 Claims, 3 Drawing Sheets

METHOD FOR ELECTROPLATING A STRIP OF FOAM

CROSS-REFERENCE TO RELATED APPLICATIONS

This application is entitled to the benefit of and incorporates by reference in their entireties essential subject matter disclosed in International Application No. PCT/EP01/10517 filed on Sep. 12, 2001 and Luxembourg Patent Application No. 90640 filed on Sep. 18, 2000.

FIELD OF THE INVENTION

The present invention generally relates to a method for electroplating a strip of foam.

BACKGROUND OF THE INVENTION

Conventionally, foam electroplating is carried out in a vertical electroplating cell. Such a cell comprises an electroplating bath and a cathode contact roll positioned outside the electroplating bath. A vertical planar anode is immersed in the bath. A strip of foam having an electrically conductive surface is continuously introduced into the bath and guided so that it travels past the anode prior to reaching the cathode roll. This cathode roll provides a cathode contact, which means that the strip of foam then functions as a cathode. Hence, when the strip passes in front of the planar anode, metal is electroplated on the strip.

Although electroplating in vertical cells is widely used, this technique shows some weaknesses. Firstly, the speed of electroplating in vertical, planar cells is relatively slow. Secondly, due to the specific resistance of the foam, a large voltage drop exists between the cathode and the electroplating bath. This may cause heating of this part of the strip and hence its damaging. Besides, as the strip is guided by the cathode roll and other idle rolls or driving rolls, the strip somewhat oscillates in the bath, especially as it passes in front of the anode, thereby causing local variations in the metal plating weight.

Document U.S. Pat. No. 4,326,931 describes a process for continuous production of porous metal. A non-conductive porous tape is treated to render it electrically conductive. The electrically conductive tape is then passed through an electrolytic bath in contact with a rotating cathode drum immersed in the bath to electrodeposit a layer of metal on the surface of the tape. Electroplating of the tape is further completed in a plurality of electrolytic baths to electroplate the tape to a desired thickness. In another embodiment, the cathode is formed by an electrically conductive belt immersed in an electrolytic bath and fed by a suitable driving means at a constant speed on a route defined by a plurality of guide rolls. Electric current is supplied to the belt from a pair of feeding terminals to the conductive belt to apply a predetermined voltage between the belt and the anode.

Document JP 63 089697 A relates to a method for plating a tape-shaped foamed body. The tape-shaped foamed body is passed through a first electroplating cell with a first side in contact with a cathode roll to plate the opposite, second face—faced outward—with a metal by about half of a predetermined amount. In a second electroplating cell, the second side is faced inward and brought into contact with a cathode roll to plate the first side of the tape-shaped foamed body by the remaining half of metal.

OBJECTS AND SUMMARY OF THE INVENTION

The object of the present invention is to provide an improved method for electroplating a strip of foam, by which a more uniform plating can be achieved. This problem is solved by a method according to the present invention.

The present invention relates to a method for electroplating a strip of foam, which has two opposite sides and an electrically conductive surface. According to the invention, the method comprises the steps of:

(a) continuously applying the strip of foam onto a moving cathode immersed in an electroplating bath so that the strip travels through the bath in contact with the moving cathode to electroplate metal on the strip of foam, a first side of the strip of foam facing a working surface of the moving cathode, and (b) continuously removing the electroplated strip of foam from the moving cathode when metal has been plated to a desired thickness.

It will be appreciated that a metal foil is continuously formed by electrode-position on the working surface of the moving cathode in such a way that the strip of foam is applied at step (a) onto the moving cathode over the metal foil. After step (b), the metal foil is continuously removed from the moving cathode.

In the method of the invention, the strip of foam is continuously supported by the moving cathode during the electroplating. Hence, contrary to the vertical cell technique, the strip does not oscillate during the plating and the anode/cathode distance remains constant, whereby a more uniform plating can be achieved. In particular, the present method permits to obtain a more uniform metal plating weight along the strip. Since the moving cathode is immersed in the bath, the portion of the strip where the electroplating takes place is supported by the cathode and the voltage drop is thus reduced. Moreover, the electroplating bath has a cooling effect on the strip of foam. These improved electroplating conditions allow to electroplate strips of foam at high speeds. In the present method the whole strip of foam travels through the bath in the same conditions and a uniform and in-depth plating can be achieved, thereby obtaining an electroplated strip of foam with an improved plating.

The moving cathode advantageously is a rotary drum having an electrically conductive surface, which forms the working surface. A cylindrically shaped anode may then be disposed in the vicinity of the drum, so as to have a constant and short anode/cathode distance, for improved plating conditions. This anode/cathode configuration forms a cylindrical electroplating cell.

The moving cathode may alternatively be an electrically conductive sheet continuously moving in the electroplating bath, the working surface being formed by an outer surface of this electrically conductive sheet. Such an electrically conductive sheet can be supported in the bath by an insulated rotary drum. The electrically conductive sheet would thus be continuously applied onto the insulated rotary drum before step (a) and removed therefrom after step (b). Instead of an insulated rotary drum the sheet can be supported in the bath by a series of insulated rolls in the way of a conveyor belt.

The term "foam" herein generally indicates a porous substrate having an electrically conductive surface and includes a variety of materials such as polymeric foams, carbon or graphite foams, silicate foams, aluminum foam and other organic or inorganic open-cellular materials. If needed, the electrical conductivity of foams can be improved, as will be explained later.

It will be understood that, due to the porosity of the foam, some metal deposits may form on the working surface of the moving cathode. Such metal deposits not only waste the electroplating metal but also impair the smoothness of the cathode working surface and are thus considered as parasitic. The presence of such parasitic metal deposits on the working surface below the foam would induce irregularities in the plating. To ensure an improved plating quality, the working surface of the moving cathode has to be kept in good condition. The method according to the invention provides a solution for ensuring that the working surface of the cathode be always in good condition for electroplating.

According to the present method, a metal foil is continuously formed by electrodeposition on the working surface of the moving cathode in such a way that the strip of foam is applied at step (a) onto the moving cathode over the metal foil. The metal foil thus protects the cathode and the parasitic metal deposits will not form on the working surface but on the metal foil covering the latter. Once, the electroplated strip of foam has been removed from the moving cathode, i.e. after step (b), the metal foil is also removed from the moving cathode, thereby restoring the working surface. The metal foil preferably has a thickness of up to 20 $\mu$m. This metal foil shall advantageously be a copper foil, as it can easily be removed by peeling.

It will be understood that at the side of the strip of foam opposed to the working surface i.e the side facing the electroplating bath, metal ions are consumed by deposition, whereas at the side in contact with the cathode, a lack of ions occurs. The electroplated strip of foam is thus advantageously guided, after step (b), to a further immersed moving cathode so as to be electroplated, with its other side in contact with this moving cathode, in substantially the same conditions as at steps (a) and (b). It is however clear that after step (b) the electroplated strip of foam can be guided through one or several other electroplating cells of the cylindrical or planar type.

In the practice of the present method, the strip of foam must have some electrical conductivity as a prerequisite for electroplating. Various techniques for making a surface electrically conductive may be used in the present method, among which: electroless plating with a metal, coating with a conductive paint containing carbon powder or a metal powder, vacuum deposition of a metal (e.g. sputtering), or chemical vapor deposition. However, the use of an electrically conductive polymer is preferred. Accordingly, the surface of the strip of foam is made electrically conductive by: firstly deposing on the strip of foam a monomer that is electrically conductive in a polymerized form, and then polymerizing the monomer into an electrically conductive polymer. Such a monomer may be pyrrole, which can be polymerized by oxidation-doping into electrically conductive polypyrrole.

Another preferred technique for rendering the strip of foam electrically conductive is physical vapor deposition (PVD), which allows to form a coherent, thin metal pre-coating at the surface of the strip of foam. Actual PVD techniques allow to form, on a strip of foam, a thin metal pre-coating that has an improved conductivity and a better tear resistance than when compared to a strip of foam rendered conductive by chemical treatment. For the manufacture of copper foams, the strip of foam shall preferably be pre-coated with a very thin layer of copper deposited by PVD.

When electroplating a strip of foam that has previously been covered by a thin metal pre-coating, it is preferable that the strip of foam be cathodically polarised prior to entering the electroplating bath, in order to prevent the dissolution of the thin metal pre-coating.

Many types of electroplating baths capable of plating a variety of metals or alloys can be employed in the present method. One suitable electroplating bath is a copper sulfate bath so as to plate copper on the strip of foam.

The electroplated foam can be further subjected to a pyrolysis treatment to eliminate the basic foam materials and the eventual conductive polymer. The obtained metallic foam may then undergo a thermal treatment under controlled atmosphere.

Depending on the intended use of the metallic foam that is to be produced, the present method may comprise the further step of electroplating a further layer of a metal or of an alloy on the electroplated strip of foam, preferably in a cylindrical electroplating cell.

For example, the present method may be used in the manufacture of negative electrodes for nickel-metal hydride (Ni-MH) batteries. The actual trend in Ni-MH batteries is to use negative electrodes featuring a porous metal substrate, preferably made from nickel, as a charge collector. Using copper, copper nickel alloy or nickel-plated copper to form the porous metal substrate of the negative electrode would prove advantageous in that it would allow to decrease the resistance of the negative electrode, since copper is an excellent electrical conductor. This means a decrease in the amount of battery power wasted due to internal dissipation, and thereby an increase in output power of the Ni-MH battery. Other potential advantages of a charge collector made from a copper foam would result from the fact that copper is more compatible with actual electrolyte systems from a chemical point of view, and notably reduces hydrogen evolution at the negative electrode (e.g. in Zn—Ni batteries).

Such a porous metal substrate for a negative electrode of a Ni-MH battery can be manufactured by the present method, which is an efficient and reliable method allowing to uniformly electroplate onto a strip of foam one, or two successive layers of a metal or of an alloy.

BRIEF DESCRIPTION OF THE DRAWINGS

The present invention will now be described, by way of example, with reference to the accompanying drawings, In which.

DETAILED DESCRIPTION OF A PREFERRED EMBODIMENT

Figure 1:
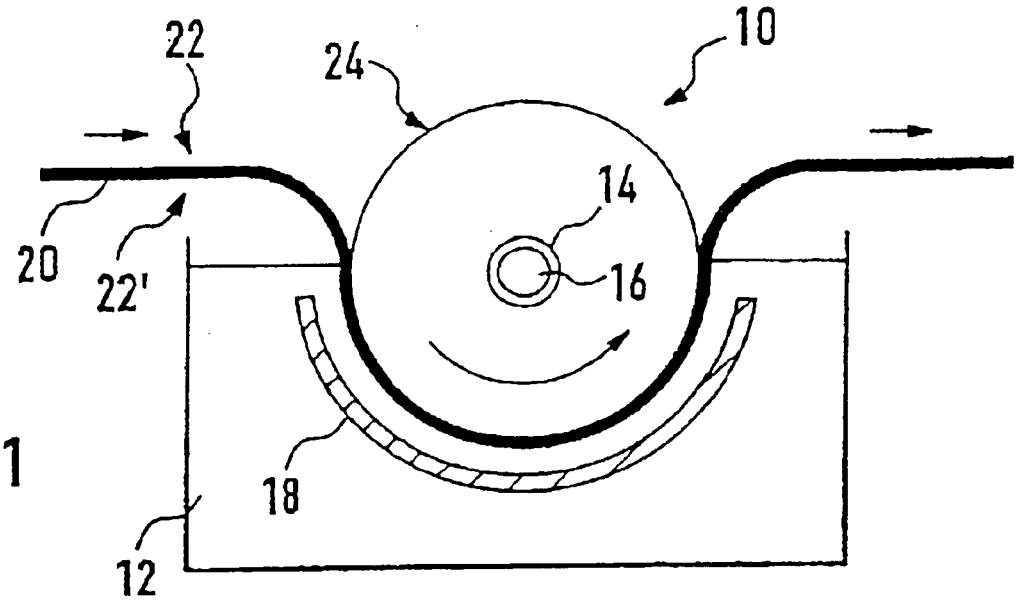
FIG. 1: is a schematic view of the electroplating of a strip of foam on an immersed rotary drum.

FIG. 1 illustrates a schematic view of a known method for electroplating a strip of as e.g. described in U.S. Pat. No. 4,326,931. A rotary drum 10, which represents a moving cathode, is immersed in an electroplating bath 12 and rotated by driving means (not shown) at a constant speed. Electric current is supplied through a slip ring 14 mounted on a drum shaft 16 so that a predetermined voltage will be applied between the rotary drum 10 and a cylindrically shaped anode 18 positioned in the vicinity of the drum 10. In a first step of the method, a strip of foam 20 having an electrically conductive surface and two opposite sides 22, 22' is continuously applied onto the drum 10 so that it travels through the bath 12 in contact with the drum 10. Thus, the strip 20 runs at the same speed as the drum 10 while being electroplated. When the strip 20 has been plated with metal to the desired thickness, it is continuously removed from the cathode drum 10. As can be seen in FIG. 1, the strip 20 is applied with a first side 22 onto an electrically conductive working surface 24 of the rotary drum 10, which is formed by the outer periphery of the drum 10.

In the electroplating cell shown in FIG. 1, which forms a cylindrical electroplating cell, the strip of foam 20 is continuously supported by the cathode drum 10 during the electroplating. Hence, contrary to the vertical cell technique, the strip of foam 20 does not oscillate during the plating and the anode/cathode distance remains constant, whereby a uniform plating is achieved. Moreover, the part of the strip of foam 20 being electroplated is in direct contact with the cathode and there are no such power losses as in vertical cells where the current has to travel through the strip from the emerged cathode roll to the electroplating zone. As the whole strip 20 travels through the electroplating cell of FIG. 1 in the same conditions, a uniform and in-depth plating, e.g. up to half the thickness of the strip, is achieved, thereby obtaining an electroplated strip of foam 20 with an improved plating.

Figure 2:
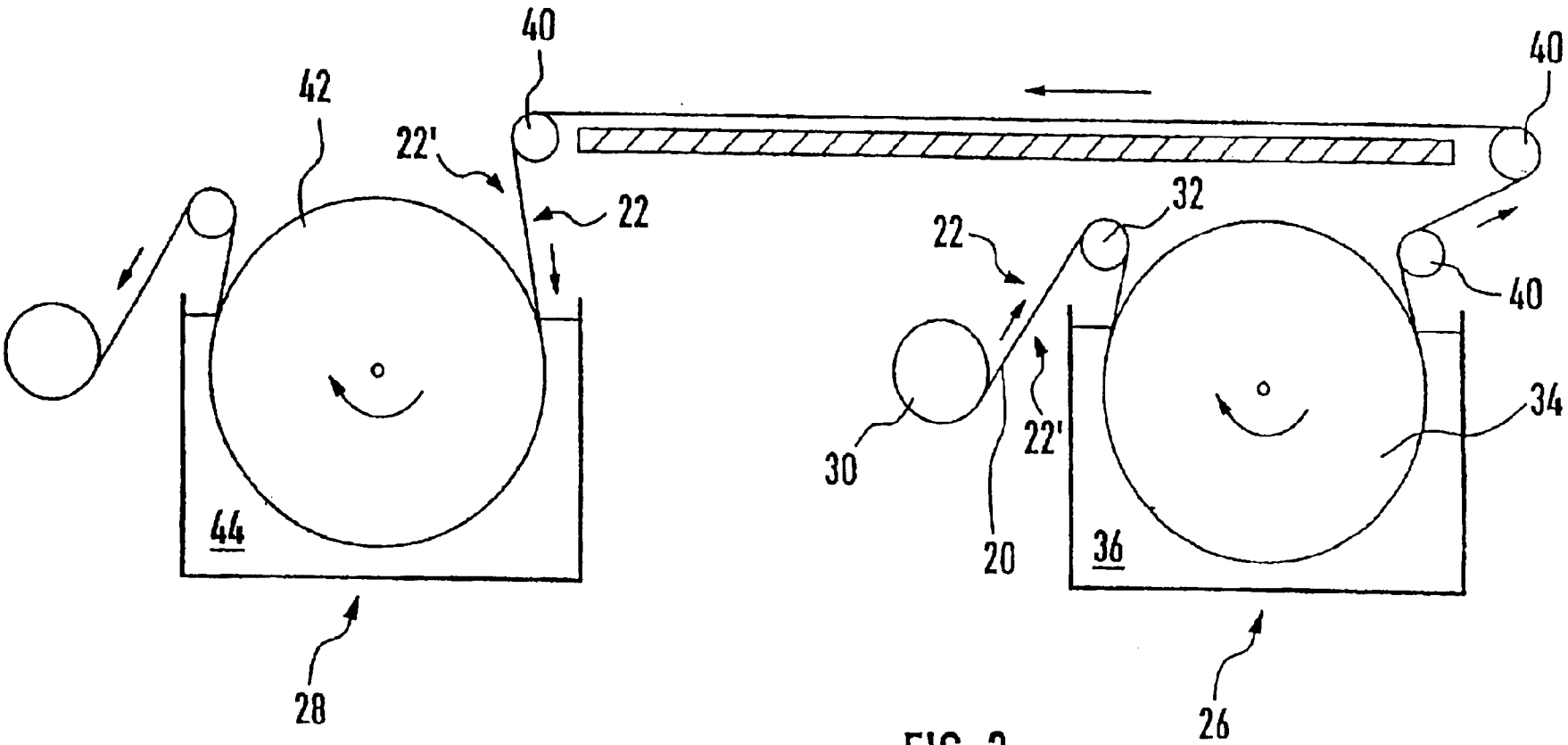
FIG. 2: is a schematic view of the electroplating of a strip of foam in two successive cylindrical electroplating cells.

It shall be noted that, at the side of the strip of foam opposed to the working surface of the cathode, metal ions are consumed by deposition, whereas at the side facing the cathode, a lack of ions occurs. Hence, the electroplated strip of foam 20 obtained with the method shown in FIG. 1 is mainly plated on the second side 22', i.e. the side which was facing the anode 18. The electroplated strip of foam 20 removed from the drum should thus advantageously be guided to another plating bath with an immersed cathode drum so as to be electroplated in equivalent conditions, however with its second side 22' applied onto the drum. Such a method comprising two successive electroplating cells is illustrated in FIG. 2, where the two cylindrical plating cells 26 and 28 are equivalent to the cylindrical cell of FIG. 1. The strip of foam 20 to be electroplated is continuously delivered from a feed roll 30 and makes a downward turn around an idle roll 32 before being applied onto a rotary drum 34 immersed in the plating bath 36 of the first cell 26. In this first plating cell 26, the first side 22 of the strip 20 faces the drum 34 and is uniformly plated with metal on its opposed, second side 22'. When exiting the first cell 26, the strip is directed to the second plating cell 28. Between the two plating cells 26 and 28, the strip 20 is guided around different idle rolls 40 in such a way that the strip 20 can be applied with its second face 22', i.e. the already plated side, onto a cathode drum 42 immersed in the electroplating bath 44 of the second plating cell 28. A conveyor belt is arranged between the two plating cells for supporting the electroplated strip, so as to reduce tearing in the strip and to prevent the formation of cracks in the plating. The electroplated strip of foam 20 exiting the second cell 28 has a uniform plating on both sides and through the whole thickness of the strip. Electroplating in such cylindrical cells allows to achieve the desired plating thickness on the strip of foam, and does not need to be completed by a further electroplating in planar cells.

It shall further be noted that the foam is generally a porous substrate with low conductivity made of a variety of organic or non-organic materials, which will be detailed later. Due to the porosity of the foam, some metal deposits may form on the working surface of the moving cathode. Such metal deposits not only waste the electroplating metal but also impair the smoothness of the cathode working surface and are thus considered as parasitic. To remove these parasitic metal deposits, the working surface should be continuously cleaned after the electroplated strip of foam has been removed, for example by means of adapted brushes.

Hence, to ensure a constant quality of the electroplating, the working surf face must be continuously kept in good condition. In this respect, the present invention provides in its following preferred embodiment a solution for keeping the working surface of a moving cathode in good condition, while being immersed in an electroplating bath.

Figure 3:
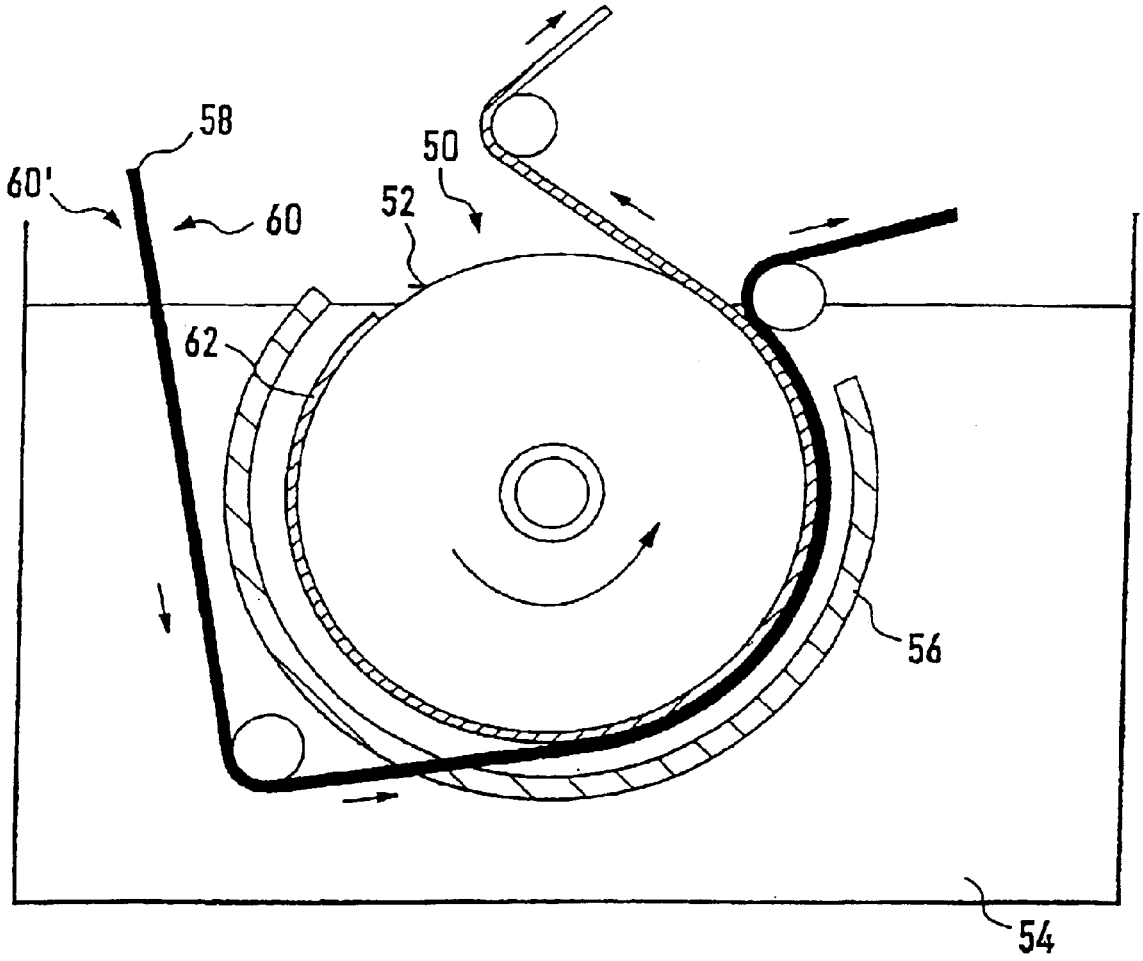
FIG. 3: is a schematic view of the electroplating of a strip of foam on a rotary cathode drum covered with a metal foil.

A preferred embodiment of the present method is schematically illustrated in FIG. 3. A rotary drum 50 having an electrically conducive working surface 52 and representing a moving cathode is immersed in an electroplating bath 54, thereby forming a cylindrical electroplating cell. An anode 56 having a cylindrical shape is located in the vicinity of the cathode drum 50 and a predetermined voltage is applied between the cathode drum 50 and the anode 56. Reference sign 58 indicates a strip of foam to be electroplated in the cylindrical cell of FIG. 3, the strip of foam 58 having two opposite sides 60 and 60' and an electrically conductive surface. It shall be appreciated that, in order to protect the working surface 52 during the plating of the strip of foam 58, a metal foil is advantageously continuously formed on the working surface 52 before applying the strip 58 onto the drum 50. This metal foil, which is indicated by reference sign 62, is formed in a conventional way between the anode 56 and the rotary cathode drum 50. As the drum 50 rotates, the metal foil 62 becomes thicker. When a predetermined thickness of the metal foil 62 has been reached, the strip of foam 58 is applied with its first side 60 onto the rotary drum 50, over the metal foil 62. As soon as the strip of foam 58 is in contact with the metal foil 62, the plating of the strip of foam 58 takes places. The metal foil 62 underlying the strip of foam 58 applied on the cathode drum 50 provides a smooth surface with a good cathodic contact for the plating of the strip of foam 58, while protecting the working surface 52 of the cathode drum 50. Indeed, the parasitic metal deposits will form on the metal foil 62 and not on the working surface 52 as it is not exposed during the plating of the strip of foam 58. Then, when the desired metal plating thickness on the strip of foam 58 has been reached, the latter is removed from the drum 50. The metal foil 62 is then removed from the working surface 52.

In the manufacture of copper foams, the electroplating bath 54 preferably is a copper sulfate electroplating bath. The metal foil 62 will thus be a copper foil, which can be grown to a thickness of e.g. up to 20 $\mu$m. A copper foil offers a smooth surface with a good cathodic contact for the plating of the strip of foam 58. Moreover, the removal of the copper foil 62 from the cathode drum is very simple, as it suffices to peel it off. The working surface 52 is thus effectively protected during the plating. The different operating parameters, such as e.g. the speed of the drum, the currents, the position where the strip of foam is applied onto the drum, should be determined in such a way as to minimize the thickness of the copper foil and to achieve the desired plating thickness of the strip of foam 58. The main requirements for the copper foil 62 is that it should be continuous and resist to the mechanical solicitations that are imposed while travelling through the electroplating cell.

As already explained, a lack of ions occurs at the side of the strip facing the cathode drum 50, i.e. the first side 60 of the strip 58. The electroplated strip of foam 58 issuing from the cylindrical cell of FIG. 3 should thus advantageously be guided to an equivalent plating cell, to be plated with its already plated second side 60' applied onto the cathode drum, i.e. in contact with the metal foil covering the cathode drum.

As already mentioned, the foam is generally a porous substrate made of organic or in-organic opencellular materials and generally has a relatively low electrical conductivity. Included are polymeric foams, carbon or graphite foams, silicate foams, synthetic or natural fibers etc . . . If needed, a foam having a too low conductivity can be made conductive by employing any of a number of well known techniques such as electroless plating with a metal, coating with a conductive paint containing carbon powder or a metal powder, vacuum deposition of a metal (e.g. sputtering), or chemical vapor deposition.

However, in the present method, conductive polymers will be preferably used to make strips of foam conductive. The main steps of this technique, which is described in EP-A-0 761 710, are the following:

pre-oxidizing the strip of foam and then rinsing the latter, covering the surface of the strip of foam with a monomer, deposing on the strip of foam a monomer that is electrically conductive in a polymerized form, polymerizing the monomer into an electrically conductive polymer.

Suitable monomers for this technique are pyrrole, furan, thiophene or some of their derivatives. A preferred monomer is pyrrole, which can be polymerized into polypyrrole. The pre-oxidation of the strip of foam is preferably carried out by immersing of the strip of foam into a potassium permanganate bath.

Another preferred technique for rendering the strip of foam electrically conductive is physical vapor deposition (PVD), which permits to form a coherent, thin metal pre-coating at the surface of the strip of foam. Actual PVD techniques allow to form on a strip of foam a metal pre-coating that has an improved conductivity and a better tear resistance than when compared to a strip of foam rendered conductive by chemical treatment For the manufacture of copper foams, the strip of foam is preferably pre-coated with a very thin layer of copper deposited by PVD.

When using metal pre-coated strips of foam, the latter should advantageously be cathodically polarised prior to entering the electroplating bath so as to prevent the dissolution of the metal pre-coating.

What is claimed is:

1. A method for electroplating a strip of foam, said strip of foam having two opposite sides and an electrically conductive surface, comprising the steps of:

(a) continuously applying the strip of foam onto a moving cathode immersed in an electroplating bath so that the strip travels through the bath in contact with the moving cathode to electroplate metal on the strip of foam, a first side of the strip of foam facing a working surface of the moving cathode, and (b) continuously removing the electroplated strip of foam from the moving cathode when metal has been plated to a desired thickness;

wherein a metal foil is continuously formed by electrodeposition on the working surface of the moving cathode in such a way that the strip of foam is applied at step (a) onto the moving cathode over the metal foil; and wherein, after step (b), the metal foil is continuously removed from the moving cathode.

2. The method according to claim 1, characterized in that the metal foil is a copper foil with a thickness of up to 20 $\mu$m.

3. The method according to any one of the preceding claims, characterized in that the moving cathode is a rotary drum having an electrically conductive surface, which forms the working surface.

4. The method according to claim 1, characterized in that the moving cathode is an electrically conductive sheet continuously moving in said electroplating bath, the working surface being formed by an outer surface of this electrically conductive sheet.

5. The method according to claim 4, characterized in that, in the electroplating bath, the electrically conductive sheet is continuously applied onto an insulated rotary drum immersed in the electroplating bath before step (a) and in that the electrically conductive sheet is continuously removed from the insulated rotary drum after step (b).

6. The method according to claim 1, characterized in that after step (b), the electroplated strip of foam is guided to a further immersed moving cathode to be electroplated, with the second side in contact with this moving cathode, in substantially the same conditions as at steps (a) and (b).

7. The method according to claim 1, characterized in that the surface of the strip of foam is made electrically conductive by:

deposing on the strip of foam a monomer that is electrically conductive in a polymerized form; and polymerizing the monomer into an electrically conductive polymer.

8. The method according to claim 7, characterized in that the monomer is pyrrole and in that the electrically conductive polymer is polypyrrole.

9. The method according to claim 1, characterized in that the surface of the strip of foam is made electrically conductive by forming a thin metal pre-coating thereon by means of physical vapor deposition.

10. The method according to claim 1, characterized in that the electroplating bath is a copper sulfate bath so as to plate copper on the strip of foam.

11. The method according to claim 1, characterized in that an alloy is electroplated on the strip of foam in step (a).

12. The method according to any one of the preceding claims, characterized by the further step of depositing a further metal or alloy layer on the electroplated strip of foam.

13. The method according to claim 1, characterized by the further step of subjecting the electroplated strip of foam to a thermal treatment under controlled atmosphere to remove the basic foam material and the possible conductive polymer.

* * * * *